US007374849B2

(12) United States Patent
Skorokhod et al.

(10) Patent No.: US 7,374,849 B2
(45) Date of Patent: May 20, 2008

(54) COATED CARRIER

(75) Inventors: Vladislav Skorokhod, Mississauga (CA); Maria N V. McDougall, Burlington (CA); Richard P N. Veregin, Mississauga (CA); Cuong Vong, Hamilton (CA); Jackie B. Parker, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 413 days.

(21) Appl. No.: 11/043,761

(22) Filed: Jan. 26, 2005

(65) Prior Publication Data

US 2006/0166125 A1 Jul. 27, 2006

(51) Int. Cl.
*G03G 9/113* (2006.01)

(52) U.S. Cl. ..... 430/111.35; 430/111.1

(58) Field of Classification Search ..... 430/111.35, 430/111.1

See application file for complete search history.

(56) References Cited

U.S. PATENT DOCUMENTS

| | | | | |
|---|---|---|---|---|
| 3,590,000 | A | 6/1971 | Palermiti et al. | 252/62.1 |
| 4,233,387 | A | 11/1980 | Mammino et al. | 430/137 |
| 4,810,611 | A | 3/1989 | Ziolo et al. | 430/106.6 |
| 4,935,326 | A | 6/1990 | Creatura et al. | 430/108 |
| 4,937,166 | A | 6/1990 | Creatura et al. | 430/130 |
| 5,656,408 | A | 8/1997 | Silence | 430/106.6 |
| 5,847,038 | A | 12/1998 | Silence et al. | 524/430 |
| 5,935,750 | A | 8/1999 | Barbetta et al. | 430/106.6 |
| 5,945,244 | A | 8/1999 | Barbetta et al. | 430/106.6 |
| 6,010,812 | A | 1/2000 | Barbetta et al. | 430/106.6 |
| 6,042,981 | A | 3/2000 | Barbetta et al. | 430/106.6 |
| 6,235,443 | B1 * | 5/2001 | Kayamoto et al. | 430/111.1 |
| 6,355,391 | B1 * | 3/2002 | Van Dusen et al. | 430/111.32 |
| 6,764,799 | B2 * | 7/2004 | Skorokhod et al. | 430/111.32 |

* cited by examiner

*Primary Examiner*—John L Goodrow
(74) *Attorney, Agent, or Firm*—E. O. Palazzo

(57) ABSTRACT

A carrier comprised of a core, and thereover a polymer coating containing antimony tin oxide with an average diameter of from about 5 to about 90 nanometers.

31 Claims, No Drawings

COATED CARRIER

CROSS-REFERENCE TO RELATED PATENTS

Illustrated in U.S. Pat. No. 5,945,244, U.S. Pat. No. 6,042,981, U.S. Pat. No. 6,010,812, and U.S. Pat. No. 5,935,750, the disclosures of each of which are totally incorporated herein by reference, are carrier particles comprised, for example, of a core with coating thereover of polystyrene/olefin/dialkylaminoalkyl methacrylate, polystyrene/methacrylate/dialkylaminoalkyl methacrylate, and polystyrene/dialkyl aminoalkyl methacrylate. More specifically, there is illustrated in U.S. Pat. No. 5,945,244 a carrier comprised of a core, and thereover a polymer of styrene, an olefin and a dialkylaminoalkyl methacrylate; in U.S. Pat. No. 6,042,981 a carrier composition comprised of a core and thereover a polymer of (1) polystyrene/alkyl methacrylate/dialkylaminoethyl methacrylate, (2) polystyrene/alkyl methacrylate/alkyl hydrogen aminoethyl methacrylate, (3) polystyrene/alkyl acrylate/dialkylaminoethyl methacrylate, or (4) polystyrene/alkyl acrylate/alkyl hydrogen aminoethyl methacrylate; in U.S. Pat. No. 6,010,812 a carrier comprised of a core and a polymer coating of (1) styrene/monoalkylaminoalkyl methacrylate or (2) styrene/dialkyl aminoalkyl methacrylate; and in U.S. Pat. No. 5,935,750 a carrier comprised of a core and a polymer coating containing a quaternary ammonium salt functionality.

The appropriate components and processes of the above recited related patents may be selected for the present invention in embodiments thereof.

BACKGROUND

This invention is generally directed to developer compositions, and more specifically, the present invention relates to developer compositions comprised of coated carrier components, or coated carrier particles that can be prepared by, for example, dry powder processes, and wherein the coating is a polymer containing an antimony tin oxide. More specifically, the present invention relates to compositions, especially carrier compositions comprised of a core, and thereover at least one polyme,r and dispersed therein and thereon antimony tin oxide of a suitable average size, such as from about 15 to about 45 nanometers, and more specifically, from about 16 to about 32 nanometers. In one form, the antimony tin oxide (ATO) possesses a more negative potential than a number of carbon blacks, and thus may not cause a reduction in negative tribo as is the situation with carbon black; and the nanometer size of the ATO ensures sufficient surface area of this filler and thus sufficient conductivity at similar volume percent loadings as carbon black. Also, in one form the ATO is light gray in color and in a powder form, thereby resulting in minimal contamination when color toners are generated and used for development.

In embodiments of the present invention, the carrier particles are comprised of a core with a coating thereover of a polymer, such as a polymethylmethacrylate (PMMA) and the like; polyvinylidenefluoride, polyethylene, copolyethylene vinylacetate, copolyvinylidenefluoride tetrafluoroethylene, polystyrene, polytetrafluoroethylene, polyvinylchloride, polyvinylfluoride, polylbutylacrylate, copolybutylacrylate methacrylate, polytrifluoroethyl methacrylate, polyurethanes, and mixtures thereof, especially a mixture of any two of these polymers, copolymers of methylmethacrylate and dimethylaminoethyl methacrylate, methylmethacrylate copolymers with substituted alkyl aminoethyl methacrylate, butylaminoethyl methacrylate, polyvinylidenefluoride and polymethylmethacrylate, and the like, and which polymer coating contains ATO. The carrier may include the polymer coating thereover in admixture with other suitable polymers, and more specifically, with a second polymer, such as a fluoropolymer, polymethylmethacrylate, poly(urethane), especially a crosslinked polyurethane, such as a poly(urethane)polyester, and the like; and moreover, the copolymer coating contains in place of a conductive component, such as a suitable carbon black, ATO of nanometer size, and which ATO component is dispersed in and on or in the polymer coating. With the ATO conductive component, there can be enabled carriers with increased developer triboelectric response at relative humidities of from about 20 to about 90 percent improved image quality performance, excellent high conductivity ranges of from about $10^{-10}$ to about $10^{-7}$ $(\text{ohm-cm})^{-1}$, and the like. A specific advantage associated with the carriers of the present invention with the polymer coatings thereover include a high triboelectrical charge (measured as charge to diameter ratio in nanocoulombs per meter), for example the carrier can provide toners with a tribocharge of from about a minus (negative charge) 0.1 to about 10, or to about 7 nanocoulombs per meter, and more specifically, from about a negative 0.2 to about a negative 4 nanocoulombs per meter, and yet most specifically, from about a negative 0.4 to about a negative 2 nanocoulombs per meter.

The carrier particles of the present invention can be selected for a number of different imaging systems and devices, such as xerographic copiers and printers, inclusive of high speed color xerographic systems, printers, digital systems, combination of xerographic and digital systems, and wherein colored images with excellent and substantially no background deposits are achievable. Developer compositions comprised of the carrier particles illustrated herein and prepared, for example, by a dry coating process are generally useful in electrostatographic or electrophotographic imaging systems, especially xerographic imaging and printing processes, and digital processes. Additionally, the invention developer compositions comprised of substantially conductive carrier particles are useful in imaging methods wherein relatively constant conductivity parameters are desired. Furthermore, in the aforementioned imaging processes the toner triboelectric charge with the carrier particles can be preselected, which charge is dependent, for example, on the polymer composition and dispersant component applied to the carrier core, and optionally the type and amount of the conductive component selected.

REFERENCES

Carrier particles for use in the development of electrostatic latent images are described in many patents including, for example, U.S. Pat. No. 3,590,000, the disclosure of which is totally incorporated herein by reference. These carrier particles can contain various cores, including steel, with a coating thereover of fluoropolymers, and terpolymers of styrene, methacrylate, and silane compounds. A number of these coatings can deteriorate rapidly, especially when selected for a continuous xerographic process where a portion of, or the entire coating may separate from the carrier core in the form of, for example, chips or flakes, and which resulting carrier can fail upon impact, or abrasive contact with machine parts and other carrier particles. These flakes or chips, which cannot generally be reclaimed from the developer mixture, usually adversely effect the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity, and relatively low triboelectrical values.

Disclosed in U.S. Pat. No. 5,656,408, the disclosure of which is totally incorporated herein by reference, are carriers containing additives or combination of additives, such as conductive carbon blacks, conductive metal oxides including tin oxide, charge control agents including distearyl dimethyl ammonium methyl sulfate (DDAMS), and the like. More specifically, disclosed in this patent are certain polyester coated carriers and developers containing conductive components such as conductive carbon black SC Ultra manufactured by Conductex, Inc., and antimony-doped tin oxide Zelec ECP3005-XC manufactured by DuPont. Incorporation of 20 percent of Conductex SC Ultra carbon black into the crosslinked polyester with a 30 percent gel content yields a carrier (1 percent coating on a steel grit core) with a conductivity value of $5.5\times10^{-10}$ mho/cm. Incorporation of 60 percent of DuPont Zelec ECP3005-XC antimony-doped tin oxide into the crosslinked polyester with a 30 percent gel content yields a carrier (1 percent coating on a steel grit core) with a conductivity value of $8.7\times10^{-12}$ mho/cm.

There is illustrated in U.S. Pat. No. 4,233,387, the disclosure of which is totally incorporated herein by reference, coated carrier components comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3 percent by weight, based on the weight of the coated carrier particles, of thermoplastic or thermosetting resin particles. The resulting mixture is then dry blended until the resin particles adhere to the carrier core by mechanical impaction, and/or electrostatic attraction. Thereafter, the mixture is heated to a temperature of from about 320° F. to about 650° F. for a period of 20 minutes to about 120 minutes enabling the resin particles to melt and fuse on the carrier core.

There is illustrated in U.S. Pat. Nos. 4,937,166 and 4,935,326, the disclosures of which are totally incorporated herein by reference, carriers containing a mixture of polymers, such as two polymers, not in close proximity in the triboelectric series. Moreover, in U.S. Pat. No. 4,810,611, the disclosure of which is totally incorporated herein by reference, there is disclosed the addition to carrier coatings of colorless conductive metal halides in an amount of from about 25 to about 75 weight percent, such halides including copper iodide, copper fluoride, and mixtures thereof. The appropriate components and processes of the '166 and '326 patents may be selected for the present invention in embodiments thereof.

Also, of interest is U.S. Pat. No. 5,656,408, the disclosure of which is totally incorporated herein by reference, which discloses developers containing certain antimony tin oxide, and in U.S. Pat. No. 5,847,038, the disclosure of which is totally incorporated herein by reference, there are illustrated developers containing metal oxides and carbon black.

When resin coated carrier particles are prepared by powder coating process, the majority of the coating materials are fused to the carrier surface thereby reducing the number of toner impaction sites on the carrier. Additionally, there can be achieved with the process of the present invention and the carriers thereof, independent of one another, desirable triboelectric charging characteristics and conductivity values; that is, for example, the triboelectric charging parameter is not necessarily dependent on the carrier coating weight as is believed to be the situation with the process of U.S. Pat. No. 4,233,387, the disclosure of which is totally incorporated herein by reference, wherein an increase in coating weight on the carrier particles may function to also permit an increase in the triboelectric charging characteristics. Specifically, therefore, with the carrier compositions and process of the present invention there can be formulated developers with selected high triboelectric charging characteristics and/or conductivity values in a number of different combinations. Thus, for example, there can be formulated in accordance with the invention of the present application developers with conductivities as determined in a magnetic brush conducting cell of from about $10^{-6}$ (ohm-cm)$^{-1}$ to about $10^{-17}$ (ohm-cm)$^{-1}$, more specifically from about $10^{-10}$ (ohm-cm)$^{-1}$ to about $10^{-6}$ (ohm-cm)$^{-1}$, and most specifically from about $10^{-8}$ (ohm-cm)-1 to about $10^{-6}$ (ohm-cm)$^{-1}$, and high values of triboelectric charge imparted by the carrier to the toner of from about negative 0.1 to about 10 nanocoulombs per meter, and, for example, from a negative about 0.5 to a negative about 2 nanocoulombs per meter on the toner particles as determined by the known charge spectrograph technique. Thus, the developers of the present invention can be formulated with conductivity values in a certain range with different triboelectric charging characteristics by, for example, maintaining the same total coating weight on the carrier particles.

Disclosed in U.S. Pat. No. 5,847,038, the disclosure of which is totally incorporated herein by reference, is a process for the preparation of carrier particles which comprises subjecting a mixture of a polymer, a conductive component, and an additive to an energy of from about 1 to about 20 kilowatt hours per kilogram, and an intensity of from about 20 to about 90 kilowatts per kilogram, and thereafter applying the polymer product obtained to a carrier core.

Other U.S. patents that may be of interest include U.S. Pat. No. 3,939,086, which illustrates steel carrier beads with polyethylene coatings, see column 6; U.S. Pat. Nos. 4,264,697; 3,533,835; 3,658,500; 3,798,167; 3,918,968; 3,922,382; 4,238,558; 4,310,611; 4,397,935; and 4,434,220, the disclosures of each of these patents being totally incorporated herein by reference.

SUMMARY

It is a feature of the present disclosure to provide toner and developer compositions with carrier particles containing polymer coatings.

In another feature of the present disclosure there are provided dry coating processes for generating carrier particles of substantially constant conductivity parameters.

In yet another feature of the present disclosure there are provided dry coating processes for generating carrier particles of substantially constant conductivity parameters, and high triboelectric charging values, which carriers contain ATO with a higher negative contact potential than a number of conductive carbon black like REGAL® carbon black.

In yet a further feature of the present disclosure there are provided carrier particles with triboelectric charging values of at least about 30 microcoulombs per gram, and wherein the carrier includes thereover a polymer, or a coating of two polymers, and particularly wherein one of the polymers is polymethylmethacrylate, and wherein the coating contains a conductive component of antimony tin oxide in a powder transparent crystalline form, preferably nanocrystallines of an average diameter of about 16 to about 32 nanometers, and which oxide is comprised of primary particles with a substantial absence of free or fused aggregates of primary particles like a number of carbon blacks, and further which oxide can be in a powder form of a light gray in color thus less contamination with color toners.

Aspects of the present disclosure relate to a carrier comprised of a core and thereover a polymer containing nanometer sized antimony tin oxide; a carrier comprised of a core, and thereover a polymer coating containing antimony tin oxide with an average diameter of from about 5 to about 90 nanometers; a carrier wherein the diameter is from about 16 to about 32 nanometers; a carrier wherein the diameter is from about 20 to about 35 nanometers; a carrier wherein the antimony tin oxide particles are substantially free of aggregated and agglomerated crystallites; a carrier wherein the polymer is a copolymer of methylmethacrylate and dimethylaminoethyl methacrylate, or a copolymer of methylmethacrylate and a monoalkylaminoalkyl methacrylate; a carrier wherein the polymer is poly(methylmethacrylate); a carrier wherein the polymer is polymethylmethacrylate prepared by emulsion polymerization with sodium dodecyl sulfate; a carrier wherein the polymer is polymethylmethacrylate with an $M_w$ of from about 20,000 to about 900,000, and an $M_n$ of from about 12,000 to about 350,000; a carrier wherein the polymer possesses an $M_w$ of from about 100,000 to about 300,000, and an $M_n$ of from about 50,000 to about 250,000; a carrier wherein the polymer coating weight is from about 0.1 to about 20 weight percent; a carrier wherein the polymer coating weight is from about 0.5 to about 3 weight percent; a carrier wherein the polymer contains dispersed therein as a conductive component the antimony tin oxide; a carrier wherein the core is a metal, a metal oxide, or a ferrite; a carrier wherein the core is iron, iron oxide or strontium ferrite; a developer comprised of the previously described carrier, and toner; a developer wherein the toner is comprised of resin and colorant; a developer wherein the colorant is a pigment and the resin is a styrene copolymer, or a polyester; a developer comprised of a (1) carrier core and polymer coating layer thereover, and wherein the polymer contains dispersed therein and thereon antimony tin oxide, and which oxide is of an average diameter of from about 5 to about 45 nanometers; and (2) a toner; a developer wherein the carrier core is selected from the group consisting of iron, ferrites, steel and nickel; a developer with a toner triboelectric charge of from about a negative 0.4 to about a negative 2 nanocoulombs per meter; a carrier wherein the carrier contains a second polymer coating; a carrier wherein the second coating is comprised of a styrene acrylate, a styrene methacrylate, or a fluoropolymer; a carrier wherein the second coating is comprised of a polyurethane, and which polyurethane optionally contains dispersed therein conductive components; a carrier wherein the second coating is comprised of a polyurethane/polyester; an imaging process which comprises developing an image with the developer previously described; a process for the preparation of the carrier previously described by the dry mixing and heating of the core, and the coating containing the antimony tin oxide; a carrier wherein the average diameter thereof is from about 15 to about 45 nanometers; a carrier wherein the average diameter thereof is from about 20 to about 35, or about 5 to about 45 nanometers; a carrier wherein the ATO is in a powder form; a carrier wherein the coating polymer is a polyalkylmethacrylate; a carrier wherein the coating polymer is polyvinylene fluoride, polymethylmethacrylate, or mixtures thereof; a carrier comprised of a core and thereover a polymer coating containing antimony tin oxide with an average diameter of from about 7 to about 150 nanometers, and optionally wherein the carrier core is of a conductivity of from about $10^{-10}$ to about $10^{-9}$ s/cm, and wherein the coated carrier is of a conductivity of about $10^{-13}$ to about $10^{-8}$ s/cm; a carrier further including a conductive carbon black; a carrier wherein the polymer coating weight thereof is from about 0.1 to about 20 weight percent; a carrier wherein the polymer coating weight is from about 1 to about 3 weight percent; a carrier wherein the polymer coating contains dispersed therein nanometer sized ATO as a conductive component in place of carbon black, and which ATO is selected in an amount of from about 10 to about 60 weight percent; a carrier wherein the core is a metal, a metal oxide, or a ferrite; a carrier that imparts to a toner a triboelectric charge of from about a negative 20 to about a negative 100 microcoulombs per gram; a carrier that imparts to a toner a triboelectric charge of from about a negative 30 to about a negative 70 microcoulombs per gram; a developer comprised of the coated carrier illustrated herein and toner particles; a developer wherein the toner is comprised of thermoplastic resin and colorant; a developer wherein the colorant is a pigment and the toner resin is a styrene copolymer, or a polyester; a developer comprised of a (1) carrier core and coating layer of a polymer or polymers and ATO (Sb—Sn oxide) as a conductive component, and (2) a toner of resin particles, colorants, and optional toner additives; a developer wherein the carrier core is selected from the group consisting of iron, ferrites, steel and nickel, and other suitable known carrier cores; a carrier wherein the polymer coating is polymethylmethacrylate, polyvinylidenefluoride, polyethylene, copolyethylene vinylacetate, copolyvinylidenefluoride tetrafluoroethylene, polystyrene, polytetrafluoroethylene, polyvinylchloride, polyvinylfluoride, polylbutylacrylate, copolybutylacrylate methacrylate, polytrifluoroethylmethacrylate, polyurethanes, and mixture thereof, and other known suitable coatings, a copolymer of methylmethacrylate/dimethylaminoethyl methacrylate; a copolymer of methylmethacrylate and tertiary-butylaminoethyl methacrylate; a copolymer of methylmethacrylate and diethylaminoethyl methacrylate; a copolymer of methylmethacrylate and diisopropylaminoethyl methacrylate; or a copolymer of methylmethacrylate and an alkylaminoethyl methacrylate; a carrier wherein the carrier contains a second polymer coating; a carrier wherein the second polymer coating is comprised of a styrene acrylate, a styrene methacrylate, or a fluoropolymer; a carrier wherein the second coating is comprised of a polyurethane, and which polyurethane contains dispersed therein ATO conductive components; a carrier wherein the second coating is comprised of a polyurethane/polyester with carbon black optionally dispersed therein; a carrier comprised of a core, and thereover a polymer or polymers of alkylmethacrylate and alkylaminoalkyl methacrylate; and a carrier comprised of a polymer coating of a substituted alkyl aminoethyl methacrylate of a tertiarybutylaminoethyl methacrylate; a carrier comprised of a core, and a coating of polymers of alkylmethacrylate and an alkylaminoalkyl methacrylate.

The present invention is directed to, for example, developer compositions comprised of toner particles, and carrier particles prepared, for example, by a powder coating process, and wherein the carrier particles are comprised of a core with coatings thereover; carrier particles prepared by mixing low density porous magnetic, or magnetically attractable metal core carrier particles with from, for example, between about 0.05 percent and about 3 percent by weight, based on the weight of polymer coated carrier particles, and which polymer may contain dispersed therein ATO, until adherence thereof to the carrier core by mechanical impaction or electrostatic attraction; heating the resulting mixture of carrier core particles and polymer to a temperature, for example, of from about 200° F. to about 625° F., preferably about 400° F. for an effective period of, for example, from about 10 minutes to about 60 minutes enabling the polymer to melt and fuse to the carrier core particles; cooling the coated carrier particles, and thereafter, classifying the obtained carrier particles to a desired particle size of, for example, from about 50 to about 200 microns in diameter.

Various suitable solid core carrier materials can be selected for the carriers and developers of the present invention. Characteristic core properties include those that in embodiments will enable the toner particles to acquire a positive charge or a negative charge, and carrier cores that will permit desirable flow properties in the developer reservoir present in a xerographic imaging apparatus. Also of value with regard to the carrier core properties are, for example, suitable magnetic characteristics that will permit magnetic brush formation in magnetic brush development processes; and also wherein the carrier cores possess desirable mechanical aging characteristics; and further, for example, a suitable core surface morphology to permit high electrical conductivity of the developer comprising the carrier and a suitable toner. Examples of carrier cores that can be selected include iron or steel, such as atomized iron or steel powders available from Hoeganaes Corporation or Pomaton S.p.A (Italy), ferrites such as Cu/Zn-ferrite containing, for example, about 11 percent copper oxide, 19 percent zinc oxide, and 70 percent iron oxide and available from D.M. Steward Corporation or Powdertech Corporation, Ni/Zn-ferrite available from Powdertech Corporation, Sr (strontium)-ferrite, containing, for example, about 14 percent strontium oxide and 86 percent iron oxide and available from Powdertech Corporation Ba-ferrite, magnetites available, for example, from Hoeganaes Corporation (Sweden), nickel, mixtures thereof, and the like. Preferred carrier cores include ferrites, and sponge iron, or steel grit with an average particle size diameter of, for example, from about 30 microns to about 400 microns, and more specifically, from about 50 to about 50 microns.

The carrier polymer coatings can be prepared by bulk polymerization which can be accomplished with suitable monomers in the absence of solvent, and by solution polymerization in a solvent medium, such as toluene, in which the monomer or mixture of monomers is combined with a suitable initiator, such as 2,2'-azobis(2-methylpropionitrile), referred to as AIBN, and reacted for an effective period of time, for example from about 7 to about 15, and preferably about 11 hours, at an elevated temperature, for example about 70° C. to about 90° C. From this reaction, a solution with a solids content of, for example, about 22.7 percent by weight of polymer can be obtained, and wherein the polymer has a glass transition of about 108° C., and molecular weight by gel permeation chromatography of $M_w$=about 90,000 with molecular weight dispersibility, that is the ratio of $M_w/M_n$, or $M_{WD}$ of about 2.3.

Suspension polymerization carrier coating methods involve mixing monomers and initiator, such as AIBN, to obtain a clear organic phase. The organic phase is then combined with an aqueous solution of Air Products Airvol 603 Polyvinyl Alcohol, and a potassium iodide aqueous phase inhibitor. The desired particle size can be obtained by homogenizing the two phases with a Brinkman homogenizer equipped with a Polytron Generator with three stationary and three moving rings of flat rotor design for about five minutes at about 8,000 RPM. The resulting suspended organic phase is then transferred to the preheated reactor and stirred at about 65 RPM to maintain stability of the suspension, maintained at 70° C. for 6 hours and 40 minutes to complete polymerization, cooled, removed from the reactor, washed and centrifuged 5 times with a 90/10 volume ratio of methanol/water, and finally washed with water only. The wet polymer suspension is then air dried, placed in a vacuum oven at from about 40° C. to about 80° C. to complete drying, and further broken down to its primary particle size by ball milling followed by screen sieving. This process yields a polymer particle size having a volume median of, for example, about 4μ, a second pass glass transition onset temperature of 95.8° C., and a molecular weight $M_w$ by gel permeation chromatography of about 520,000 with an about $M_{WD}$ of about 2.2.

Emulsion polymerization carrier polymer preparation can be accomplished by the continuous addition to a suitable reaction vessel containing water, and providing mechanical stirring, a nitrogen atmosphere, and thermostatic control, of a mixture of monomers and an initiator, such as ammonium persulfate initiator obtained from Aldrich Chemical Company (0.2 to 0.6 percent by weight of monomers). The polymerization can be effected by heating to, for example, from about 55° C. to about 65° C. to achieve polymer molecular weights, $M_w$ as determined by gel permeation chromatography ranging from, for example, about 200,000 to about 900,000. The polymer or copolymer powder resulting can be isolated by freeze drying in a vacuum. The residue free latex, and the resulting polymer particle diameter size is, for example, from about 0.1 to about 2 microns in volume average diameter.

The process for incorporating the polymer onto a carrier core can be sequential, a process in which one of the two polymers, when two polymers are selected, is fused to the surface, and the second polymer is fused to the surface in a subsequent fusing operation. Alternatively, the process for incorporation can comprise a single fusing.

Also, the carrier coating can have incorporated therein various known charge enhancing additives, such as quaternary ammonium salts, and more specifically, distearyl dimethyl ammonium methyl sulfate (DDAMS), bis[1-[(3,5-disubstituted-2-hydroxyphenyl)azo]-3-(mono-substituted)-2-naphthalenolato(2-)]chromate(1-), ammonium sodium and hydrogen (TRH), cetyl pyridinium chloride (CPC), FANAL PINK® D4830, and the like, including those as illustrated in a number of the patents recited herein, and other effective known charge agents or additives. The charge additives are selected in various effective amounts, such as from about 0.05 to about 15, and from about 0.1 to about 3 weight percent, based, for example, on the sum of the weights of polymer, conductive additive, and charge additive components. The addition of various known charge enhancing additives can act to further increase the triboelectric charge imparted to the carrier, and therefore, further increase the negative triboelectric charge imparted to the toner in, for example, a xerographic development subsystem.

Examples of second carrier coating polymers selected can include polymonoalkyl or dialkyl methacrylates or acrylates, polyurethanes, fluorocarbon polymers such as polyvinylidenefluoride, polyvinylfluoride, and polypentafluorostyrene, polyethylene, polyethylene-co-vinylacetate, polyvinylidene fluoride-co-tetrafluoroethylene, and the like, inclusive of other known suitable polymers. Other known related polymers can be selected, such as those illustrated in the U.S. Pat. Nos. 4,937,166 and 4,935,326 patents mentioned herein, the disclosures of which are totally incorporated herein by reference.

A specific second polymer is comprised of a thermosetting polymer and yet, more specifically, a poly(urethane) thermosetting resin which contains, for example, from about 75 to about 95, and preferably about 80 percent by weight of a polyester polymer, which when combined with an appropriate crosslinking agent, such as isopherone diisocyanate, and initiator, such as dibutyl tin dilaurate, forms a crosslinked poly(urethane) resin at elevated temperatures. An example of a polyurethane is poly(urethane)/polyester polymer or Envirocron (product number PCU10101, obtained from PPG Industries, Inc.). This polymer has a melt temperature of between about 210° F. and about 266° F., and a crosslinking temperature of about 345° F. This second polymer is mixed together with the first polymer, generally prior to mixing with the core, which when fused forms a uniform coating of the first and second polymers on the carrier surface. The second polymer is present in an amount of from about 0 percent to about 99 percent by weight based on the total weight of the first and second polymers and the conductive component in the first polymer. More than two polymer carrier coatings may also be selected, such as from about 3 to about 7 polymer coatings.

Various effective suitable processes can be selected to apply the polymer, or mixture thereof, for example from about 2 to about 5, and more specifically 2, of polymer coatings to the surface of the carrier particles. Examples of typical processes for this purpose include combining the carrier core material, polymer or polymers, and ATO by cascade roll mixing, or tumbling, milling, shaking, electrostatic powder cloud spraying, fluidized bed, electrostatic disc processing, and an electrostatic curtain. Following application of the polymers and ATO, heating is initiated to permit flow out of the coating material over the surface of the carrier core. The concentration of the coating material powder particles, and the parameters of the heating may be selected to enable the formation of a continuous film of the coating polymers on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-7}$ to about $10^{-17}$ mho-cm$^{-1}$ as measured, for example, across a 0.1 inch magnetic brush at an applied potential of 10 volts; and wherein the coating coverage encompasses from about 10 percent to about 100 percent of the carrier core. Moreover, known solution processes may be selected for the preparation of the coated carriers.

Illustrative examples of toner binders, include thermoplastic resins, which when admixed with carrier generates developer compositions, such binders including styrene based resins, styrene acrylates, styrene methacrylates, styrene butadienes, polyamides, epoxies, polyurethanes, diolefins, vinyl resins, polyesters, such as those obtained by the polymeric esterification products of a dicarboxylic acid and a diol comprising a diphenol. Specific vinyl monomers that can be selected are styrene, p-chlorostyrene vinyl naphthalene, unsaturated mono-olefins, such as ethylene, propylene, butylene and isobutylene; vinyl halides, such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; styrene butadiene copolymers; mixtures thereof; and other similar known resins.

As one toner resin, there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers; styrene/butylacrylate copolymers, styrene/butylacrylate/acrylic acid copolymers, styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol. Also, the crosslinked and reactive extruded polyesters of U.S. Pat. No. 5,376,494, the disclosure of which is totally incorporated herein by reference, may be selected as the toner resin.

Generally, from about 1 part to about 5 parts by weight of toner particles are mixed with from about 10 to about 300 parts by weight of the carrier particles.

Numerous well known suitable colorants, such as pigments, dyes, or mixtures thereof, and preferably pigments can be selected as the colorant for the toner particles including, for example, carbon black, nigrosine dye, lamp black, iron oxides, magnetites, and mixtures thereof, known cyan, magenta, yellow pigments, and dyes. The colorant, which is preferably carbon black, should be present in a sufficient amount to render the toner composition highly colored. Thus, the colorant can be present in amounts of, for example, from about 1 percent by weight to about 20, and preferably from about 5 to about 12 percent by weight, based on the total weight of the toner components, however, lesser or greater amounts of colorant may be selected. Illustrative examples of magentas that may be selected include 1,9-dimethyl-substituted quinacridone and anthraquinone dye identified in the Color Index as CI 60720, CI Dispersed Red 15, a diazo dye identified in the Color Index as CI 26050, CI Solvent Red 19, Pigment Blue 15:3, and the like. Examples of cyans that may be used include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. Other known suitable colorants, such as reds, blues, browns, greens, oranges, and the like, inclusive of dyes thereof can be selected. These colorants are generally present in the toner composition in an amount of from about 1 weight percent to about 15, and, for example, from about 2 to about 12 weight percent based on the weight of the toner components of binder and colorant.

When the colorant particles are comprised of magnetites, which are a mixture of iron oxides ($FeO.Fe_2O_3$), including those commercially available as MAPICO BLACK®, they are present in the toner composition in an amount of from about 10 percent by weight to about 70 percent by weight, and preferably in an amount of from about 20 percent by weight to about 50 percent by weight.

Colorant includes pigment, dye, mixtures thereof, mixtures of pigments, mixtures of dyes, and the like.

The resin particles are present in a sufficient, but effective amount, thus when 10 percent by weight of pigment, or colorant, such as carbon black like REGAL 330®, is contained therein, about 90 percent by weight of binder material is selected. Generally, the toner composition is comprised of from about 85 percent to about 97 percent by weight of toner resin particles, and from about 3 percent by weight to about 15 percent by weight of colorant particles such as carbon black.

For further enhancing the charging characteristics of the developer compositions described herein, and as optional components, there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives, such as metal complexes, BONTRON E-84™, BONTRON E-88™, and the like. These additives are usually selected in an amount of from about 0.1 percent by weight to about 20, and, for example, from about 3 to about 12 percent by weight. These charge additives can also be dispersed in the carrier polymer coating as indicated herein.

The toner composition of the present invention can be prepared by a number of known methods including melt blending the toner resin particles, and colorants followed by mechanical attrition, in situ emulsion/aggregation/coalescence, reference U.S. Pat. Nos. 5,370,963; 5,344,738; 5,403,693; 5,418,108; 5,364,729 and 5,405,728, the disclosures of which are totally incorporated herein by reference, and the like. Other methods include those well known in the art such as spray drying, melt dispersion, dispersion polymerization and suspension polymerization. In one dispersion polymerization method, a solvent dispersion of the resin particles and the colorant are spray dried under controlled conditions to result in the desired product. Various toner particle sizes and shapes are known and include, for example, a toner size of from about 2 to about 25, and preferably from about 6 to about 14 microns in volume average diameter as determined by a Coulter Counter; shapes of irregular, round, spherical, and the like may be selected.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990; 4,585,884; 4,584,253, and 4,563,408, the disclosure of each patent being totally incorporated herein by reference, and other similar layered photoresponsive devices. Examples of generating layers are trigonal selenium, metal phthalocyanines, metal free phthalocyanines, titanyl phthalocyanines, hydroxygallium phthalocyanines, and vanadyl phthalocyanines. As charge transport molecules there can be selected the aryl diamines disclosed in the aforementioned patents, such as the '990 patent. These layered members are conventionally charged negatively thus requiring a positively charged toner.

Images, especially colored images obtained with the developer compositions of the present invention in embodiments possess, for example, acceptable solids, excellent halftones, and desirable line resolution with acceptable or substantially no background deposits, excellent chroma, superior color intensity, constant color chroma and intensity over extended time periods, such as 1,000,000 imaging cycles, and the like.

The following Examples are provided.

SYNTHETIC EXAMPLE I

95 Grams of a latex emulsion of methyl methacrylate (MMA) monomer were added to a solution of 1 gram of SLS (sodium dodecyl sulfate) surfactant in 1.01 liter of distilled water, which had been degassed by stirring at 200 rpm for 1 hour at a circulating bath temperature of 68° C. Polymerization of the resulting emulsion was initiated by the addition of 1.1 gram of ammonium persulfate dissolved in 3.3 grams of distilled water. After initiation was completed, the remaining monomer mixture was added by means of a metering pump at a rate of 1.2 gram/minute. The final latex emulsion was determined to contain 22 percent of copolymer solids. The particle size of the latex was found to be 0.08 μm by Scanning Electron Microscopy. Isolation of the polymethyl methacrylate submicron (about 0.8 micron) powder was accomplished by freeze drying such that the residual water content was approximately 1 percent by weight.

SYNTHETIC EXAMPLE II

The process of Example I was repeated with the exception that there was selected as the monomer a monomer mixture of 25 weight percent trifluoroethyl methacrylate and 75 weight percent methyl methacrylate.

CARRIER COMPARATIVE EXAMPLE III

1 Weight percent of polymethyl methacrylate submicron powder generated from Synthetic Example 1 and 99 weight percent of 35 micrometer ferrite carrier core were premixed in a paint shaker for 20 minutes and melt mixed in a Haake melt-mixer at 190° C. to fuse the polymer powder to the carrier core.

The triboelectric properties of the coated carrier were evaluated by the triboelectric charge imparted by the carrier to a cyan toner selected from a Xerox Corporation DocuCentre® 2240 as a charge-per-diameter ratio measured in a charge spectrograph. The triboelectric properties were measured after mixing 20 grams of carrier in a Turbula mixer for 60 minutes with 1 gram of a cyan toner selected from a Xerox Corporation DocuCentre® 2240. The toner and the carrier were then conditioned overnight, about 20 hours, in A zone wherein the relative humidity was 85 percent RH and the temperature was 28° C., and C zone wherein the relative humidity was 15 percent and the temperature was 10° C. prior to measurements. Mixing was performed in the corresponding zones for 2 minutes and 60 minutes.

Toner charge was −0.64 nanocoulombs per meter in the A zone, and −1.29 nanocoulombs per meter in the C zone.

About 30 to about 50 grams of the above prepared carrier were placed between two circular planar parallel steel electrodes (radius=3 centimeters), and compressed by a weight of 4 kilograms to form an about 0.4 to about 0.5 centimeter layer; the DC voltage of 100 volts was applied between the electrodes, and a DC current was measured in series between the electrodes and voltage source after 1 minute following the moment of voltage application; conductivity in S/cm was obtained by multiplying current in Amperes, by layer thickness in centimeters, and divided by the electrode area in $cm^2$ and by 100 volts.

The conductivity measured for the coated carrier of this Example was 2.48×10^−15 S/cm.

CARRIER COMPARATIVE EXAMPLE IV

The process of Example III was repeated with the exception that the coating polymer (PMMA) was mixed with 5 volume percent of VULCAN® carbon black (Cabot). The toner charge with this carrier was −0.46 nanocoulomb per meter in A zone, and −1.20 nanocoulombs per meter in the C zone. The conductivity measured for the carrier of this Example was 6.01×10^−11 S/cm.

CARRIER COMPARATIVE EXAMPLE V

The process of Example III was repeated with the exception that the coating polymer (PMMA) was mixed with 10 volume percent of VULCAN® carbon black (Cabot). The toner charge with this carrier was −0.23 nanocoulomb per meter in A zone, and −0.64 nanocoulomb per meter in the C zone. The conductivity measured for the coated carrier of this Example was 7.32×10^−10 S/cm.

CARRIER EXAMPLE VI

The process of Example III was repeated with the exception that the coating polymer (PMMA) was mixed with 5 volume percent of antimony tin oxide powder in the form of unaggregated, unagglomerated isolated crystallites (which powder was obtained from Nanophase Technologies Corporation, Burr Ridge, Ill.) with average particle size of 16 nanometers. The toner charge with this carrier was −0.64 nanocoulomb per meter in A zone, and −1.29 nanocoulombs per meter in C zone. The measured conductivity for the coated carrier of this Example was 9.91×10^−11 S/cm.

CARRIER EXAMPLE VII

The process of Example III was repeated with the exception that the coating polymer (PMMA) was mixed with 5 volume percent of ATO powder with average particle size of 32 nanometers, which powder was comprised of unaggregated, unagglomerated isolated crystallites, and which powder was obtained from Nanophase Technologies Corporation (Burr Ridge, Ill.). The toner charge with this carrier was −0.55 nanocoulomb per meter in the A zone, and −1.38 nanocoulombs per meter in the C zone. The measured conductivity for the coated carrier of this Example was 1.63×10^−10 S/cm.

CARRIER EXAMPLE VIII

The process of Example III was repeated with the exception that the coating polymer (PMMA) was mixed with 10 volume percent of ATO powder with an average particle size of 32 nanometers. The toner charge with this carrier was −0.46 nanocoulomb per meter in the A zone, and −1.15 nanocoulombs per meter in the C zone. The measured conductivity for the coated carrier of this Example was 3.28×10^−9 S/cm.

CARRIER COMPARATIVE EXAMPLE IX

3 Weight percent of polymethyl methacrylate 0.45 micron powder commercially available from Esprit Technologies and premixed with 5 volume percent of VULCAN® carbon black (Cabot Corporation) and 97 weight percent of 35 micrometer ferrite carrier core were premixed in a paint shaker for 20 minutes and then melt mixed in a Haake melt-mixer at 190° C. to fuse the polymer powder to the carrier core. The toner charge with this carrier was −0.46 nanocoulomb per meter in the A zone, and −1.15 nanocoulombs per meter in the C zone. The measured conductivity for the coated carrier of this Example was 6.68×10^−13 S/cm.

CARRIER EXAMPLE X

The process of Example IX was repeated with the exception that 5 volume percent of the coating polymer (PMMA with carbon black) was mixed with 5 volume percent of the above ATO powder with an average particle size of 16 nanometers, reference Example VI. The toner charge with this carrier was −0.46 nanocoulomb per meter in the A zone, and −1.29 nanocoulombs per meter in the C zone. The measured conductivity for the coated carrier of this Example was 3.64×10^−11 S/cm.

CARRIER EXAMPLE XI

The process of Example IX was repeated with the exception that 5 volume percent of the carbon black was mixed with 5 volume percent of ATO powder with an average particle size of 32 nanometers, reference Example VII. The toner charge with this carrier was −0.46 nanocoulomb per meter in the A zone, and −1.38 nanocoulombs per meter in the C zone. The measured conductivity for this coated carrier was 1.81×10^−12 S/cm.

CARRIER COMPARATIVE EXAMPLE XII

1 Weight percent of polymethyl methacrylate 0.45 micron powder commercially available from Esprit Technologies and premixed with 9 volume percent of VULCAN® carbon black (Cabot Corporation) and 99 weight percent of 65 micrometer iron carrier core were premixed in a paint shaker for 20 minutes, and then melt mixed in a Haake melt mixer at 190° C. to fuse the polymer powder to the carrier core. The toner charge with this carrier was measured by mixing carrier and the above cyan toner of Example III for 60 minutes. Then the mixture was placed in a Faraday Cage and the toner was blown off for 3 minutes while the residual charge was measured on the cage with a Keithley electrometer to determine the charge:mass ratio of the toner. The toner charge with this carrier was −9 microcoulombs per gram in the A zone, and −19 microcoulombs per gram in the C zone. The measured conductivity for this coated carrier was 1.92×10^−7 S/cm.

CARRIER EXAMPLE XIII

The process of Example XII was repeated with the exception that 9 volume percent of the carbon black was mixed with 5 volume percent of the ATO powder which powder possessed an average particle size of 32 nanometers, reference Example VII. The toner charge with this carrier was −14 microcoulombs per gram in the A zone, and −24 microcoulombs per gram in the C zone. The measured conductivity for the coated carrier of this Example was 1.77×10^−7 S/cm. The conductivity level remains essentially the same as with carbon black (CB), and the tribo level achieved was higher by 5 units than with the carbon black of Example XII.

CARRIER EXAMPLE SUMMARY

The Table below illustrates, for example, that the substitution of carbon black with an equal volume amount of ATO with particle sizes of 16 nanometers or 32 nanometers results, for example, in an increase in carrier conductivity, and excellent charging values.

| Carrier Example No. | | Core | Coating Polymer | Conductive Filler Type | Conductive Filler (Vol. percent) | Coating Wt. Percent | Conductivity (S/cm) | Charge, A-zone | Charge, C-zone |
|---|---|---|---|---|---|---|---|---|---|
| | | | | | | | | (nC/m) | (nC/m) |
| III | Comparative | 35 μm ferrite | 0.08 μm PMMA | None | 0 | 1 | 2.48E−15 | 0.64 | 1.29 |
| IV | Comparative | 35 μm ferrite | 0.08 μm PMMA | CB | 5 | 1 | 6.01E−11 | 0.46 | 1.2 |
| V | Comparative | 35 μm ferrite | 0.08 μm PMMA | CB | 10 | 1 | 7.32E−10 | 0.23 | 0.64 |
| VI | | 35 μm ferrite | 0.08 μm PMMA | 16 nm ATO | 5 | 1 | 9.91E−11 | 0.64 | 1.29 |
| VII | | 35 μm ferrite | 0.08 μm PMMA | 32 nm ATO | 5 | 1 | 1.63E−10 | 0.55 | 1.38 |
| VIII | | 35 μm ferrite | 0.08 μm PMMA | 32 nm ATO | 10 | 1 | 3.28E−09 | 0.46 | 1.15 |
| IX | Comparative | 35 μm ferrite | 0.45 μm PMMA | CB | 5 | 3 | 6.68E−13 | 0.46 | 1.15 |
| X | | 35 μm ferrite | 0.45 μm PMMA | 16 nm ATO | 5 | 3 | 3.64E−11 | 0.46 | 1.29 |
| XI | | 35 μm ferrite | 0.45 μm PMMA | 3 nm ATO | 5 | 3 | 1.81E−12 | 0.46 | 1.38 |
| | | | | | | | | (uC/g) | (uC/g) |
| XII | Comparative | 65 μm steel | 0.45 μm PMMA | CB | 9 | 1 | 1.92E−07 | 9 | 19 |
| XIII | | 65 μm steel | 0.45 μm PMMA | 32 nm ATO | 9 | 1 | 1.77E−07 | 14 | 24 |

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A carrier comprised of a core and thereover a polymer coating containing antimony tin oxide with an average diameter of from about 5 to about 98 nanometers, and wherein said antimony tin oxide is free of aggregated and agglomerated crystallites.

2. A carrier in accordance with claim 1 with a measured conductivity of $9.91\times10^{-11}$ s/cm.

3. A carrier in accordance with claim 1 wherein said diameter is from about 20 to about 35 nanometers.

4. A carrier in accordance with claim 1 wherein said polymer is a copolymer of methylmethacrylate and dimethylaminoethyl methacrylate, or a copolymer of methylmethacrylate and a monoalkylaminoalkyl methacrylate.

5. A carrier in accordance with claim 1 wherein the polymer is poly(methylmethacrylate).

6. A carrier in accordance with claim 1 wherein said polymer is polymethylmethacrylate prepared by emulsion polymerization with sodium dodecyl sulfate.

7. A carrier in accordance with claim 1 wherein said polymer is polymethylmethacrylate with an $M_w$ of from about 20,000 to about 900,000, and an $M_n$ of from about 12,000 to about 350,000.

8. A carrier in accordance with claim 1 wherein said polymer possesses an $M_w$ of from about 100,000 to about 300,000, and an $M_n$ of from about 50,000 to about 250,000.

9. A carrier in accordance with claim 1 wherein the polymer coating weight is from about 0.1 to about 20 weight percent.

10. A carrier in accordance with claim 1 wherein the polymer coating weight is from about 0.5 to about 3 weight percent.

11. A carrier in accordance with claim 1 wherein said core is a metal, a metal oxide, or a ferrite.

12. A carrier in accordance with claim 1 wherein said core is iron, iron oxide or strontium ferrite.

13. A developer comprised of the carrier of claim 1 and toner.

14. A developer in accordance with claim 13 wherein the toner is comprised of resin and colorant.

15. A developer in accordance with claim 14 mwherein the colorant is a pigment and the resin is a styrene copolymer, or a polyester.

16. A developer comprised of a (1) carrier core and polymer coating layer thereover containing antimony tin oxide with an average diameter of from about 5 to about 98 nanometers, and wherein said antimony tin oxide is free of aggregated and agglomerated crystallites; and (2) a toner.

17. A developer in accordance with claim 16 wherein the carrier core is selected from the group consisting of iron, ferrites, steel and nickel.

18. A developer in accordance with claim 16 with a toner triboelectric charge of from about a negative 0.4 to about a negative 2 nanocoulombs per meter.

19. A carrier in accordance with claim 1 wherein the carrier contains a second polymer coating.

20. A carrier in accordance with claim 19 wherein the second coating is comprised of a styrene acrylate, a styrene methacrylate, or a fluoropolymer.

21. A carrier in accordance with claim 19 wherein said second coating is comprised of a polyurethane, and which polyurethane optionally contains dispersed therein conductive components.

22. A carrier in accordance with claim 19 wherein said second coating is comprised of a polyurethane/polyester.

23. An imaging process which comprises developing an image with the developer of claim 16.

24. A process for the preparation of the carrier of claim 1 by the dry mixing and heating of said core, and said coating containing said antimony tin oxide.

25. A carrier in accordance with claim 1 wherein said average diameter is from about 15 to about 45 nanometers.

26. A carrier in accordance with claim 1 wherein said oxide is in a powder form.

27. A carrier in accordance with claim 1 wherein said polymer is a polyalkylmethacrylate.

28. A carrier in accordance with claim 1 wherein said polymer is polyvinylene fluoride, polymethylmethacrylate, or mixtures thereof.

29. A carrier in accordance with claim 1 further including a conductive carbon black.

30. A carrier in accordance with claim 1 wherein said diameter is from about 16 to about 32 nanometers.

31. A carrier in accordance with claim 1 wherein the conductivity thereof is from about $10^{-13}$ to about $10^{-8}$ s/cm.

* * * * *